US009833822B2

(12) United States Patent
Ueoka et al.

(10) Patent No.: US 9,833,822 B2
(45) Date of Patent: Dec. 5, 2017

(54) METHOD AND APPARATUS FOR COOLING HOT-ROLLED STEEL STRIP

(71) Applicant: JFE STEEL CORPORATION, Chiyoda-ku, Tokyo (JP)

(72) Inventors: Satoshi Ueoka, Tokyo (JP); Takeshi Chiba, Tokyo (JP); Kazuya Ibuki, Tokyo (JP); Yoshitsugu Iijima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/655,104

(22) PCT Filed: Nov. 27, 2013

(86) PCT No.: PCT/JP2013/006952

§ 371 (c)(1),
(2) Date: Jun. 24, 2015

(87) PCT Pub. No.: WO2014/103164

PCT Pub. Date: Jul. 3, 2014

(65) Prior Publication Data

US 2015/0321234 A1 Nov. 12, 2015

(30) Foreign Application Priority Data

Dec. 25, 2012 (JP) ..... 2012-280418

(51) Int. Cl.
*B21B 45/02* (2006.01)

(52) U.S. Cl.
CPC ..... *B21B 45/0218* (2013.01); *B21B 45/0233* (2013.01)

(58) Field of Classification Search
CPC ..... B21B 45/0203; B21B 45/0209; B21B 45/0215; B21B 45/0218; B21B 45/0233; B05B 9/002; B05B 9/035; B22D 11/1246
See application file for complete search history.

(56) References Cited

U.S. PATENT DOCUMENTS 4,591,133 A * 5/1986 Umeno ..... C21D 9/46 266/114
4,932,232 A * 6/1990 Ballyns ..... B05B 12/04 239/563

(Continued)

FOREIGN PATENT DOCUMENTS

CN 101456040 6/2009
EP 1952902 8/2008

(Continued)

OTHER PUBLICATIONS

Extended European Search Report for European Application No. PCT/JP2013/006952 dated Dec. 16, 2015.

(Continued)

*Primary Examiner* — Edward Tolan
(74) *Attorney, Agent, or Firm* — RatnerPrestia

(57) ABSTRACT

Provided are a cooling method and a cooling apparatus that, in the cooling of a hot-rolled steel strip, regulates the amount of cooling water in a two-stage manner for each set of headers in the width direction and changes the rate at which the steel strip is cooled, in a multistage manner by a simple method, and that is effective particularly in cooling the lower surface of the steel strip, where space is narrow. The spray nozzles 5 are arranged in a row in the width direction of the steel strip at a predetermined pitch. Two systems of cooling headers 6 are arranged for one set so that spray nozzles 5 adjacent in the width direction can be supplied with cooling water from different pipe systems, and a spray valve 7 is attached to each cooling header 7 so that spraying/stop of spraying of cooling water can be individually performed.

12 Claims, 10 Drawing Sheets

(56) References Cited

U.S. PATENT DOCUMENTS

| | | | | |
|---|---|---|---|---|
| 6,185,970 | B1 * | 2/2001 | Latzel | B21B 37/76 72/200 |
| 8,012,406 | B2 * | 9/2011 | Yamamoto | B21B 45/0233 148/637 |
| 2006/0060271 | A1 * | 3/2006 | Fujibayashi | B21B 45/0218 148/638 |
| 2009/0019907 | A1 * | 1/2009 | Ueoka | B21B 45/0218 72/201 |
| 2009/0108509 | A1 | 4/2009 | Seruzawa | |
| 2009/0126439 | A1 * | 5/2009 | Ueoka | B21B 45/0218 72/201 |
| 2010/0024505 | A1 * | 2/2010 | Ueoka | B21B 45/0233 72/202 |
| 2010/0312399 | A1 * | 12/2010 | Borgmann | B21B 45/0218 700/282 |
| 2011/0018178 | A1 * | 1/2011 | Muller | B21B 45/004 266/44 |
| 2012/0068391 | A1 * | 3/2012 | Eto | B21B 45/0218 266/44 |
| 2012/0079863 | A1 * | 4/2012 | Hosho | B21B 45/0218 72/201 |

FOREIGN PATENT DOCUMENTS

| | | |
|---|---|---|
| JP | 5947010 | 3/1984 |
| JP | 060166413 | 11/1985 |
| JP | 0239604 | 10/1990 |
| JP | 07214136 | 8/1995 |
| JP | 10192951 | 7/1998 |
| JP | 2006035311 | 2/2006 |

OTHER PUBLICATIONS

International Preliminary Report on Patentability for International Application No. PCT/JP2013/006952 dated Jun. 30, 2015.

Written opinion of the International Searching Authority for International Application No. PCT/JP2013/006952 dated Feb. 25, 2014.

Korean Notice of Allowance for Korean Application No. 10-2015-7011419 dated Mar. 22, 2016.

International Search Report for International Application No. PCT/JP2013/006952, dated Feb. 25, 2014.

Chinese Office Action dated Jul. 13, 2016 for Chinese Application No. 201380067906.9, including Concise Statement of Relevance, 16 pages.

Japanese Office Action for Japanese Application No. 2012-280418, dated Apr. 28, 2015, including Concise Statement of Relevance of Office Action, 4 pages.

* cited by examiner

METHOD AND APPARATUS FOR COOLING HOT-ROLLED STEEL STRIP

CROSS REFERENCE TO RELATED APPLICATIONS

This is the U.S. National Phase application of PCT/JP2013/006952, filed Nov. 27, 2013, which claims priority to Japanese Patent Application No. 2012-280418, filed Dec. 25, 2012, the disclosures of these applications being incorporated herein by reference in their entireties for all purposes.

FIELD OF THE INVENTION

The present invention relates to a cooling method and a cooling apparatus that make it possible to, when a hot-rolled steel strip is cooled by controlled cooling in a hot-rolled steel strip manufacturing line, regulate the rate at which the hot-rolled steel strip is cooled, in a multistage manner.

BACKGROUND OF THE INVENTION

A hot-rolled steel strip (hereinafter also simply referred to as a steel strip) is manufactured by rolling a heated slab such that the slab has a desired size. In this case, the hot-rolled steel strip is cooled using cooling water (water cooling) by a cooling apparatus during hot rolling (rough rolling, finish rolling) or after finish rolling. The purpose of this water cooling is to mainly control deposit or transformation structure of the steel strip and to regulate the quality of material so that intended strength, ductility, and the like can be obtained. In particular, accurately controlling at a predetermined temperature in the cooling after finish rolling is important in manufacturing hot-rolled steel strips having intended material properties without variation.

In recent years, as a result of soaring rare metal costs, methods have been developed that improve mechanical properties by transformation structure control based on cooling instead of alloy composition regulation. In the above-described water cooling, there is a great need for wide range control of cooling rate in response to requirements for material quality. In a typical run out table in the manufacturing of a hot-rolled steel strip, arrangement of pipe laminar nozzles for the upper surface and spray nozzles for the lower surface is often used as a cooling apparatus. The amount of cooling water is about 0.4 to 1.0 $m^3/min \cdot m^2$ per one surface. For a steel strip having a thickness of 3 mm, a cooling rate of about 50 to 70° C./s is provided.

Recently, as regards hot-rolled high tensile strength steel, there has been a great need for further increasing cooling rate and aggressively performing transformation structure control. On the other hand, steel strips used, for example, for automotive bodies are sometimes soft steel strips and are formed into complicated shapes from the viewpoint of design or the like. Such steel strips are often required to have workability such as ductility rather than strength. If the cooling rate is too high, this workability may be impaired. So, such a cooling technique that cooling rate can be largely changed using the same cooling apparatus is required.

As regards hot-rolled steel strips, the passing performance of steel strips varies depending on, in particular, thickness. Unfortunately, difficulties occur. As regards high tensile steel for automobiles, most of steel strips have thicknesses from about 1.2 to 3.0 mm. In particular, a thin steel strip having a thickness of about 1.2 mm has poor stiffness and provides high passing speed. Accordingly, if the steel strip is passed while a large amount of cooling water is poured, the steel strip tends to bound or loop due to fluid resistance. So, a technique for reducing the amount of cooling water only when the thickness is small is also needed.

As described above, there is a great need for a technique for controlling cooling rate/amount of cooling water in order to control the size and target material of a steel strip. In response to this, there is, for example, a cooling technique described in Patent Literature 1.

PATENT LITERATURE

Patent Literature 1: Japanese Unexamined Patent Application Publication No. 59-47010

SUMMARY OF THE INVENTION

Patent Literature 1 describes, as an example of a typical cooling apparatus, a technique to change the flow rate density using spray pressure. According to this technique, the flow rate of cooling water is proportional to the spray pressure raised to the power of 0.5. Therefore, if the spray pressure is decreased, the change in flow rate is small. Therefore, it is very difficult to largely change the cooling rate. In general, it is said that the cooling rate is proportional to the amount of cooling water raised to the power of about 0.7. Therefore, the change in cooling rate is proportional to the spray pressure raised to the power of about 0.35. Therefore, for example, when reducing the cooling rate by about half, it is beneficial to reduce the spray pressure by about 1/7. However, it is difficult to cause a typical flow control valve to carry out such an operation.

Patent Literature 1 discloses a technique concerning such an apparatus that spray nozzles are arranged in a water tank in a lower surface cooling apparatus, the spray nozzles are submerged by filling the water tank with cooling water, and cooling is performed by swirling up the cooling water in the water tank using the momentum of sprayed water. This technique changes the distance between the liquid level of the water tank and the tips of the spray nozzles in order to regulate the amount of swirled-up water.

A problem of this technique is that, particularly in the case of the lower surface of a steel strip, sprayed cooling water falls into the water tank after colliding with the steel strip, therefore the water tank is always supplied with a very large amount of water, and the regulation of liquid level is difficult. In the water tank into which a large amount of water falls from above, due to the fallen water, waves are formed locally on the liquid surface, and the liquid level fluctuates. Therefore, the amount of water swirled up by each nozzle changes, and the flow rate of spray to the steel strip varies.

There also is a publicly known technique to make the cooling rate variable by changing the cooling water amount density by changing the distance between spray nozzles and a slab in continuous casting equipment. Cooling water sprayed from spray nozzles is sprayed so as to spread at an angle. Therefore, the larger the distance between a steel strip and nozzles, the smaller the amount of cooling water per unit area (water amount density), and the cooling rate can be regulated.

The above-described technique changes the flow rate density by changing the distance between a steel strip and nozzles. Therefore, in principle, regulation of cooling rate is easy. However, on the steel strip lower surface side of the run out table, where space is narrow, changing the height regulating function of nozzles is difficult. As regards the lower surface of the steel strip, cooling water colliding with the steel strip falls. Therefore, cooling headers are always exposed to cooling water. Therefore, a nozzle elevating mechanism for changing the distance from the steel strip may fail to operate due to corrosion or the like. Since the height of spray nozzles is regulated, the area of cooling water colliding with the steel strip changes. If the distance between the steel strip and spray nozzles is extremely increased, the cooling area becomes excessively large, cooling water may collide with and be blocked by table rollers or the like, the flow rate density is difficult to control, effective cooling of the steel strip is not performed, and this is not economical.

The present invention has been made in consideration of the above-described circumstances and provides a cooling method and a cooling apparatus effective in cooling the lower surface of a hot-rolled steel strip, particularly in cooling the lower surface of a steel strip, where space is narrow.

To solve the above-described problems, the present invention includes the following aspects.

[1] A method for cooling a hot-rolled steel strip, comprising: preparing a cooling apparatus including a plurality of cooling headers having a plurality of spray nozzles arranged in a width direction, the cooling headers being arranged in a steel strip conveying direction, supply of cooling water being performed using two systems as one set in the cooling headers, valves being attached to the two systems of supply pipes of cooling water so that spraying or stop of spraying of cooling water can be independently performed; spray nozzles adjacent in the width direction being connected to supply pipes of different systems of the two systems of supply pipes, wherein when increasing cooling rate, cooling water is supplied to one set of cooling headers from two systems of supply pipes and cooling water is sprayed from all of the spray nozzles of the one set of cooling headers, and wherein when decreasing cooling rate, cooling water is supplied to one set of cooling headers from one system of supply pipe and cooling water is sprayed from every other spray nozzle attached to the one set of cooling headers in the width direction.

[2] The method for cooling a hot-rolled steel strip according to the above-described [1], wherein two sets of the cooling headers in the steel strip conveying direction are referred to as a pair, spray nozzles attached to the pair of cooling headers are placed at the same position in the steel strip conveying direction, and when spraying cooling water from one system of the two systems of supply pipes in each pair, the spray nozzles of the pair of two sets spray cooling water from alternate positions in the width direction.

[3] The method for cooling a hot-rolled steel strip according to the above-described [1] or [2], wherein the spray nozzles have a rectangular or elliptic spray pattern, and are arranged in such a manner that, when performing supply of cooling water from two systems and when cooling water collides with the steel strip, the position of the end of the spray colliding part collides with a position located on the opposite side of the central axis of the adjacent nozzle from the nozzle spraying cooling water and located 0 to 30 mm from the central axis of the adjacent nozzle.

[4] The method for cooling a hot-rolled steel strip according to any one of the above-described [1] to [3], wherein two sets of the cooling headers in the steel strip conveying direction are referred to as a pair, and in the pair, spray nozzles attached in the width direction are placed at the same position in the steel strip conveying direction, and the nozzle attachment positions in the width direction of cooling headers of adjacent pairs are displaced by ½ of nozzle attachment pitch.

[5] The method for cooling a hot-rolled steel strip according to any one of the above-described [1] to [4], wherein the upper surface and lower surface of the steel strip differ in cooling water amount density, and, in each cooling headers for the upper surface and lower surface of the steel strip, the number of supply pipes for cooling water is changed individually.

[6] The method for cooling a hot-rolled steel strip according to any one of the above-described [1] to [5], wherein the method is applied to cooling of the lower surface of the steel strip.

[7] A cooling apparatus including a plurality of cooling headers having a plurality of spray nozzles arranged in a width direction, the cooling headers being arranged in a steel strip conveying direction, wherein supply of cooling water is performed using two systems as one set in the cooling headers, spray valves are attached to the two systems of supply pipes of cooling water so that spraying or stop of spraying of cooling water can be independently performed, and spray nozzles adjacent in the width direction have pipe systems connected to supply pipes of different systems of the two systems of supply pipes, and wherein the apparatus includes a control mechanism that makes it possible to, when increasing cooling rate, supply cooling water to one set of cooling headers from two systems of supply pipes and spray cooling water from all of the spray nozzles of the one set of cooling headers, and to, when decreasing cooling rate, supply cooling water to one set of cooling headers from one system of supply pipe and spray cooling water from every other spray nozzle attached to the one set of cooling headers in the width direction.

[8] The apparatus for cooling a hot-rolled steel strip according to the above-described [7], wherein two sets of the cooling headers in the steel strip conveying direction are referred to as a pair, and spray nozzles attached to the pair of cooling headers are placed at the same position in the steel strip conveying direction, and wherein the apparatus has a control function capable of opening and closing the spray valves in such a manner that, when spraying cooling water from one system of the two systems of supply pipes in each pair, the spray nozzles of the pair of two sets spray cooling water from alternate positions in the width direction.

[9] The apparatus for cooling a hot-rolled steel strip according to the above-described [7] or [8], wherein the spray nozzles have a rectangular or elliptic spray pattern, and are arranged in such a manner that, when cooling water collides with the steel strip, the position of the end of the spray colliding part is located on the opposite side of the central axis of the adjacent nozzle from the nozzle spraying cooling water and is located 0 to 30 mm from the central axis of the adjacent nozzle.

[10] The apparatus for cooling a hot-rolled steel strip according to any one of the above-described [7] to [9], wherein two sets of the cooling headers in the steel strip conveying direction are referred to as a pair, and in the pair, spray nozzles attached in the width direction are placed at the same position in the steel strip conveying direction, and the nozzle attachment positions in the width direction of cooling headers of adjacent pairs are displaced by ½ of nozzle attachment pitch.

[11] The apparatus for cooling a hot-rolled steel strip according to any one of the above-described [7] to [10], wherein the apparatus has a control function that, when two-system cooling water is supplied, is capable of spraying in such a manner that the upper surface and lower surface of the steel strip differ in cooling water amount density, and is capable of opening and closing the spray valves in order to change the number of supply systems for cooling water individually, in each cooling headers for the upper surface and lower surface of the steel strip.

[12] The apparatus for cooling a hot-rolled steel strip according to any one of the above-described [7] to [11], wherein the apparatus is applied to cooling of the lower surface of the steel strip.

The present invention can provide a cooling technique that, in the cooling of a hot-rolled steel strip, regulates the amount of cooling water in a two-stage manner for each set of headers in the width direction and changes the rate at which the steel strip is cooled, in a multistage manner by a simple method, and that is effective particularly in cooling the lower surface of the steel strip, where space is narrow.

By applying the present invention to the cooling after finish rolling in the hot-rolled steel strip manufacturing line, the cooling rate can be easily regulated. Therefore, various hot-rolled steel strips can be made. In addition, it is made possible to manufacture hot-rolled steel strips having the same strength, toughness, and the like as those of conventional ones without adding a special element.

DETAILED DESCRIPTION OF EMBODIMENTS OF THE INVENTION

Embodiments of the present invention will be described with reference to the drawings.

Figure 1:
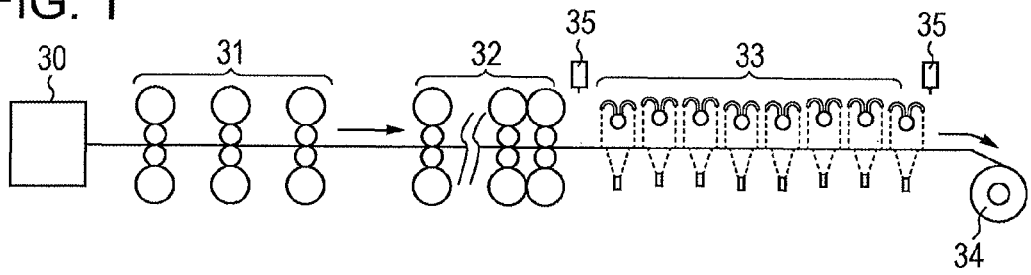
FIG. 1 illustrates an embodiment of the present invention.

FIG. 1 illustrates an embodiment concerning a cooling apparatus in the case where the present invention is applied to the cooling of the lower surface of a hot-rolled steel strip on a run out table.

As regards the hot-rolled steel strip, a slab (having a thickness of, for example, 250 mm), which is a raw material, is heated (up to, for example, 1200° C.) by a heating furnace 30 and is subsequently rolled at a predetermined thickness through a rough rolling mill group 31 and a finish rolling mill group 32 and is then cooled by a cooling apparatus 33 and is coiled by a coiler 34.

Figure 2:
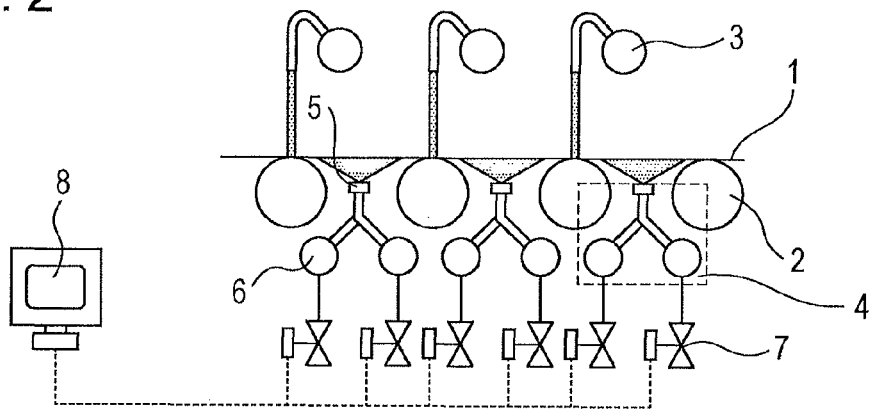
FIG. 2 is a detailed diagram of a cooling apparatus of an embodiment of the present invention.

FIG. 2 shows the details of the cooling apparatus 33 in FIG. 1. There are table rollers 2 conveying a steel strip 1, above which are placed pipe laminar nozzles 3 cooling the upper surface of the steel strip, and spray cooling apparatuses 4 cooling the lower surface of the steel strip are placed between the table rollers 2. In general, flat spray nozzles that spray in a sector form are attached as the spray nozzles 5. The spray cooling apparatuses 4 include a set of two systems of headers 6 and spray valves 7. As regards the spray valves 7, spraying/stop of spraying of cooling water can be set individually using a control mechanism 8.

Figure 3:
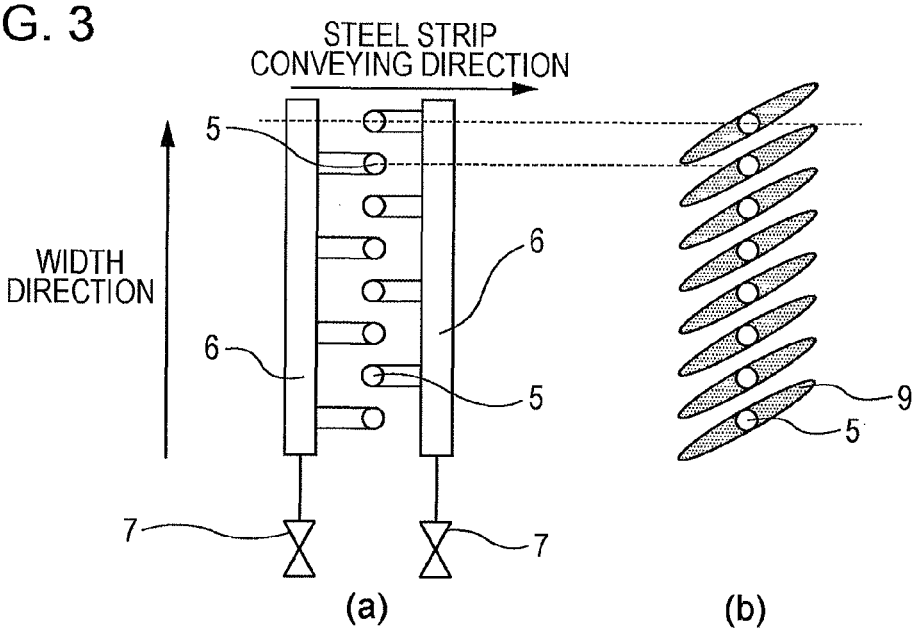
FIG. 3 illustrates a pipe system of a spray cooling apparatus and a pattern of collision of flat sprays with a steel strip.

FIG. 3 (*a*) illustrates pipe systems of a spray cooling apparatus 4 placed in an inter-table-roller space. The spray nozzles 5 are arranged in a row in the width direction of the steel strip at a predetermined pitch. Two systems of cooling headers 6 are arranged so that spray nozzles 5 adjacent in the width direction can be supplied with cooling water from different pipe systems, and a spray valve 7 is attached to each cooling header 7 so that spraying/stop of spraying of cooling water can be individually performed.

FIG. 3 (*b*) shows a pattern when flat sprays at that time collide with the steel strip. The position in the width direction of the end part of sprayed water 9 is arranged so as to be located on the opposite side of the central axis of the nozzle adjacent to the spray nozzle 5 spraying sprayed water 9, in the width direction, from the nozzle spraying cooling water and so as to be located 0 to 30 mm from the central axis of the adjacent nozzle.

Figure 4:
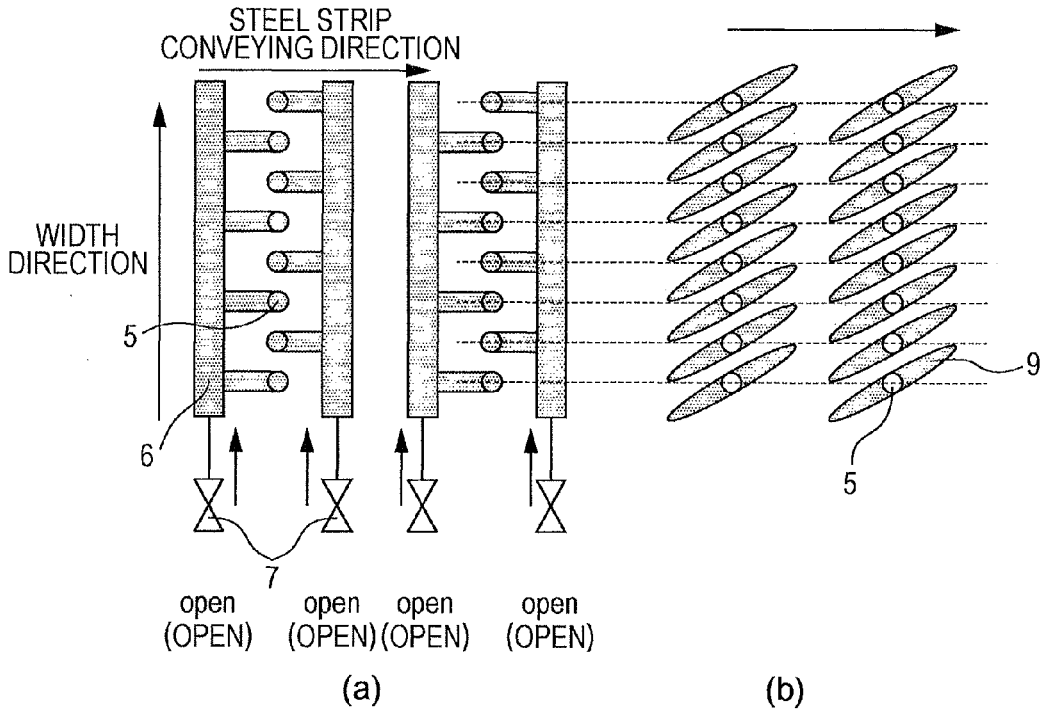
FIG. 4 shows spraying as two-system cooling water in a lower-surface cooling apparatus.
Figure 5:
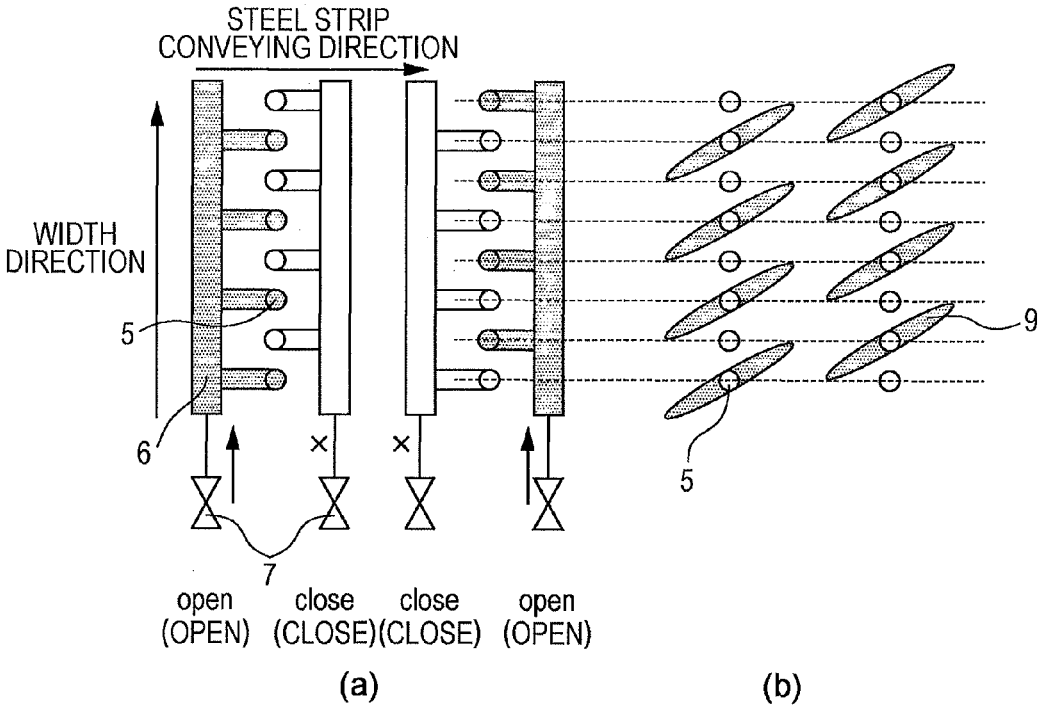
FIG. 5 shows spraying as one-system cooling water in the lower-surface cooling apparatus.

Thus, in a set of lower surface cooling apparatuses arranged between table rollers, the spray amount of cooling water can be regulated by alternately performing spray in the width direction from adjacent spray pipes as two-system cooling water shown in FIG. 4 or one-system cooling water shown in FIG. 5.

Figure 6:
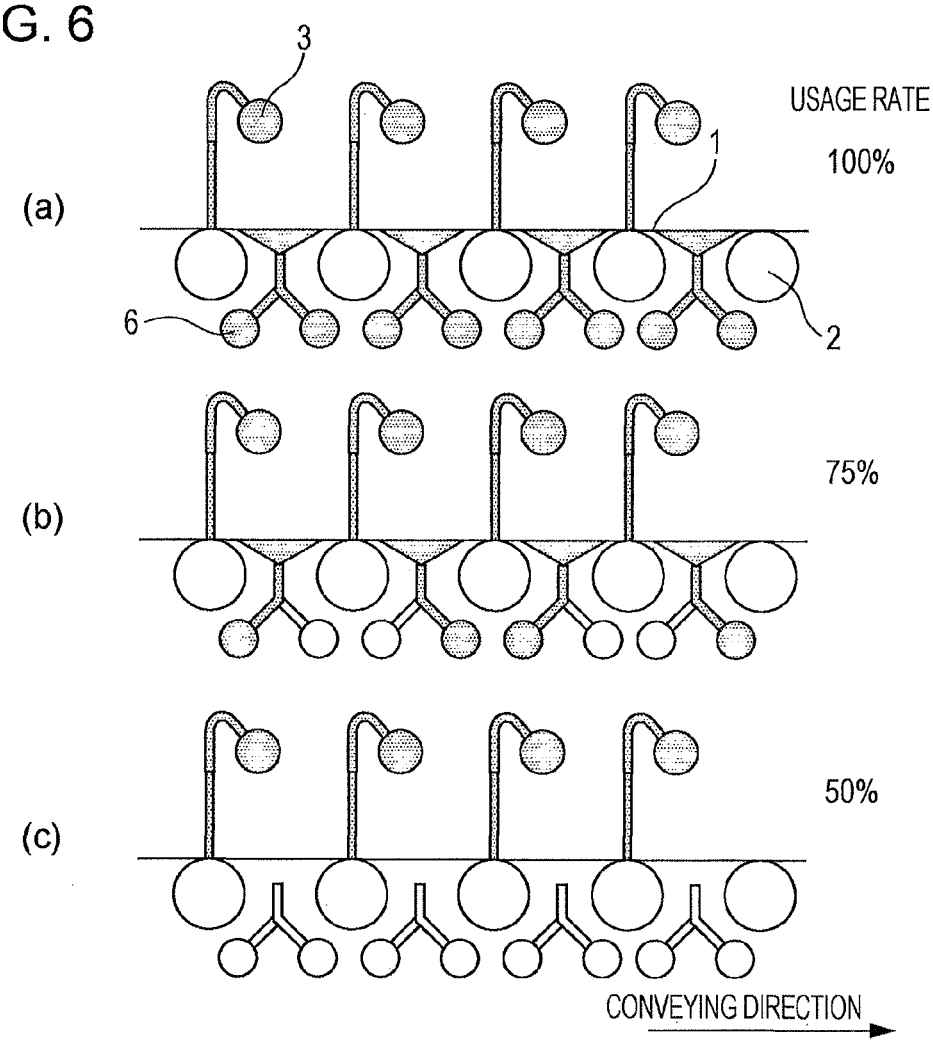
FIG. 6 shows patterns of changing the spray rate of cooling water.

Suppose that the spray rate in the case where the pipe laminar nozzles 3 for the upper surface discharge sprays is 50%, the spray rate in the case where spray cooling apparatuses 4 for the lower surface discharge sprays in a one-set two-system manner is 50%, and the total spray rate of the upper and lower surfaces in the case where all discharge sprays to the upper surface/lower surface is 100%. In a state where the pipe laminar nozzles 3 for the upper surface discharge sprays as shown in FIG. 6, in the case where the spray nozzles 4 for the lower surface discharge sprays in a two-system manner (FIG. 4 and FIG. 6 (*a*)), the spray rate of cooling water is 100% (upper surface: 50%, lower surface: 50%) and the water cooling rate is highest; in the case where the spray nozzles 4 for the lower surface discharge sprays in a one-system manner (FIG. 5 and FIG. 6 (*b*)), the spray rate of cooling water is 75% (upper surface: 50%, lower surface: 25%) and the water cooling rate is medium; and in the case where the spray nozzles 4 for the lower surface do not discharge sprays (FIG. 6 (*c*)), the spray rate of cooling water is 50% (upper surface: 50%, lower surface: 0%) and the water cooling rate can be made lowest.

This method is characterized in that the amount of cooling water can be set only by spraying/stop of spraying of cooling water using the spray valves 7 and the control mechanism 8. Therefore, spraying/stop of spraying of cooling water can be switched using typical valves, and therefore the amount of cooling water can be set extremely easily. By increasing the opening and closing speed of the spray valves 7, the cooling water amount density can be set extremely rapidly. For example, when high-speed on-off valves called cylinder valves are used, switching is completed in an operating time of one second or less. Compared to this, when typical flow rate density control is carried out, flow control valves need to be attached. The valve opening is fine-tuned while measuring with a flow meter. Therefore, when typical flow control valves are used, a time of about 5 to 10 seconds is required depending on the diameter of pipes. When the distance between the nozzles and the steel strip is changed as in Patent Literature 1, the height needs to be regulated using a servomotor or the like, and rapid switching is difficult.

Figure 7:
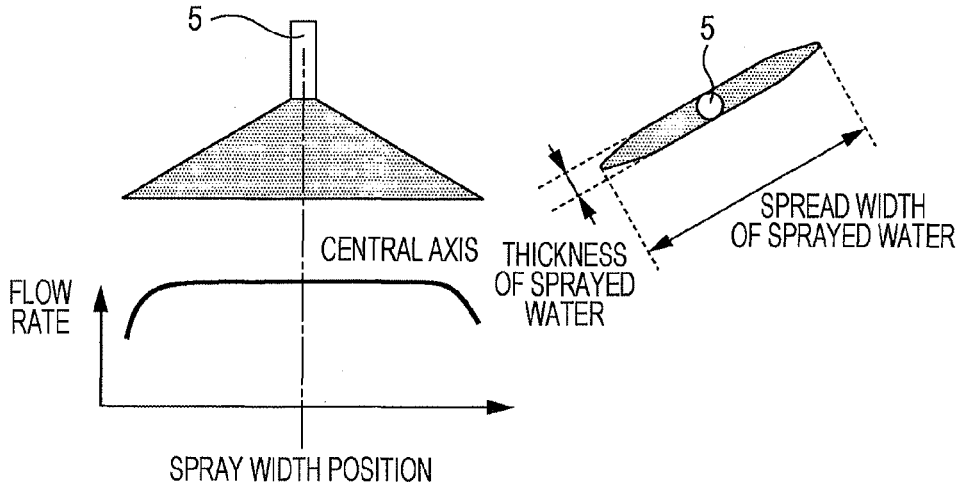
FIG. 7 shows the flow rate distribution of a typical flat spray.
Figure 8:
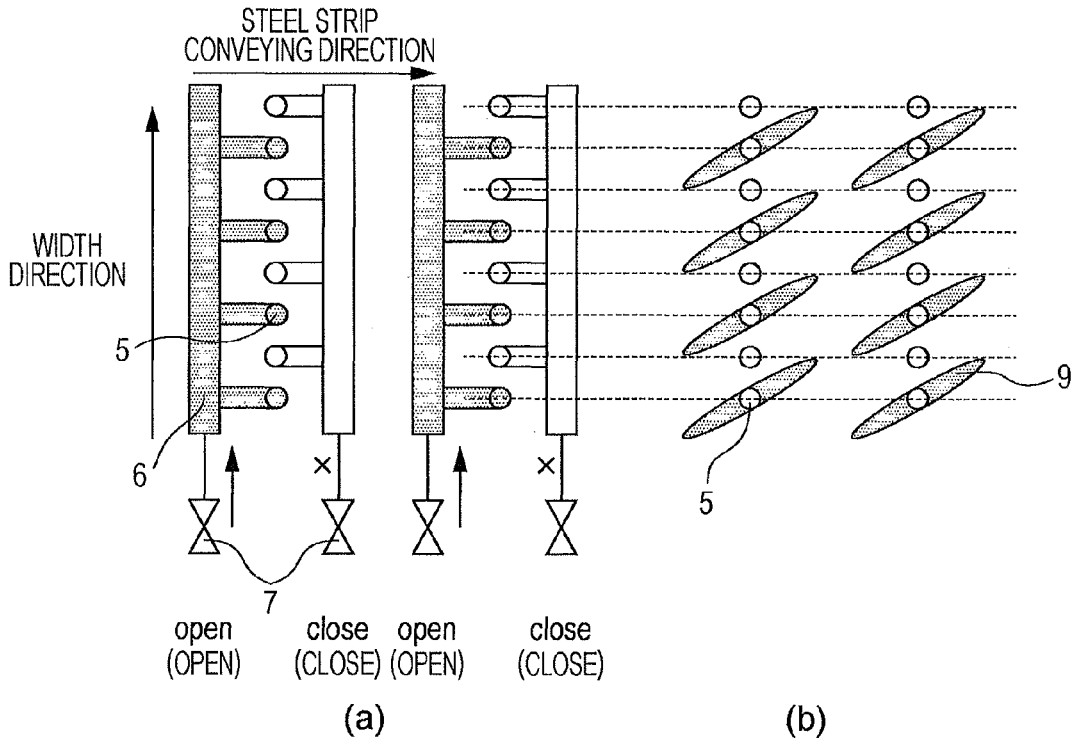
FIG. 8 shows spraying as one-system cooling water in a lower-surface cooling apparatus.
Figure 9:
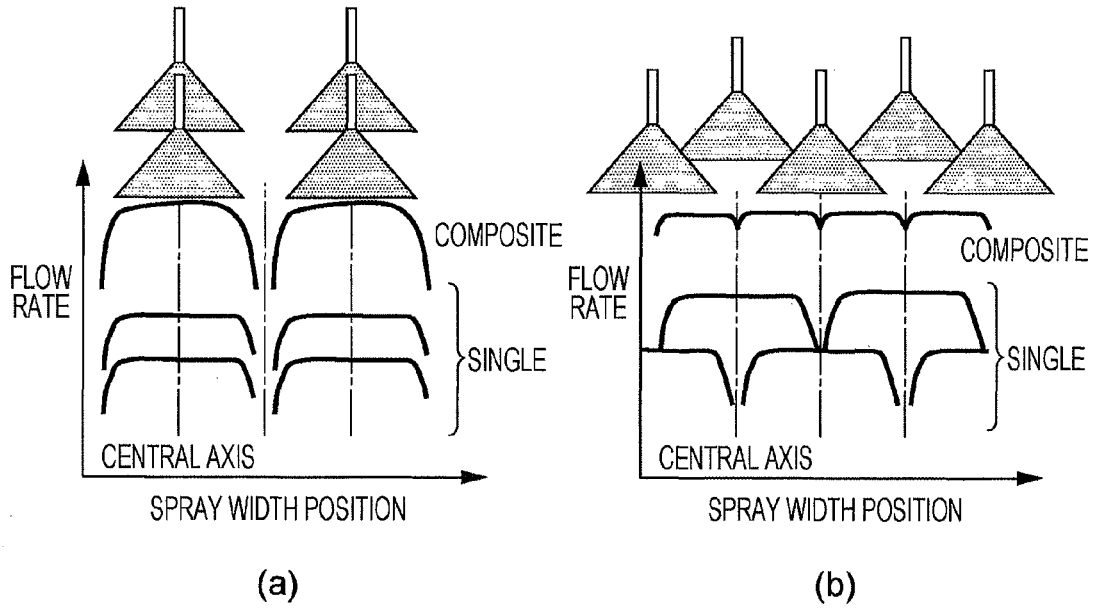
FIG. 9 illustrates the positions of the ends of sprays in the width direction.

FIG. 7 shows the flow rate distribution of a typical flat spray nozzle. The flow rate sprayed from the spray tends to decrease at the ends in the width direction. When water supply to spray nozzles 5 for the lower surface is performed in a one-system manner, water supply pipes in adjacent inter-table-roller spaces preferably spray cooling water from alternate positions. However, a schematic diagram of the flow rate distribution when cooling water is sprayed in a one-system manner in the arrangement shown in FIG. 8 is as shown in FIG. 9 (*a*). In the case of spraying from the same positions in the width direction, the ends of sprays located in different inter-table-roller spaces are located at the same positions in the width direction. Therefore, in the composite flow rate distribution in the conveying direction, the flow rate decreases at positions corresponding to the ends of sprays. So, by alternating the water supply positions of water supply pipes, the positions of the ends of sprays are dispersed as shown in FIG. 5 and FIG. 9 (*b*), and the composite flow rate distribution in the conveying direction can be approximated to uniform.

Figure 10:
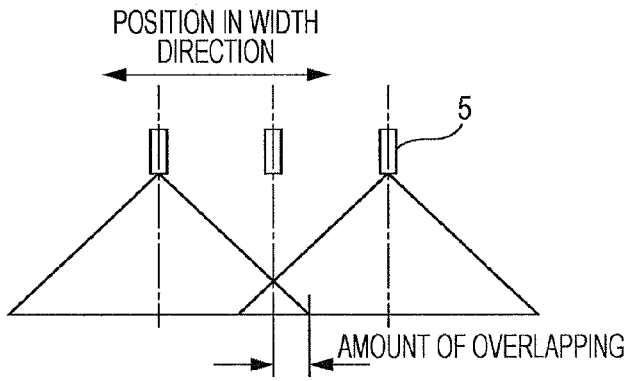
FIG. 10 shows a state where the positions of the ends of sprays overlap with each other slightly.

The position in the width direction of the end when cooling water sprayed from a spray nozzle collides with the steel strip is preferably located at the position of the central axis of the adjacent nozzle, but may be arranged so as to spread slightly to the opposite side of the central axis of the adjacent nozzle from the nozzle spraying cooling water. When spray is performed in a one-system manner, spray is performed alternately in one system as shown in FIG. 10. Due to this arrangement, the end positions of sprays overlap with each other slightly. Therefore, the ends of sprays, where the flow rate is low, can be complemented, and therefore this is more preferable. Considering the flow rate distribution of typical sprays and the variation in spread angle of sprayed water, the amount of overlap is practically preferably about 0 to 30 mm.

Figure 11:
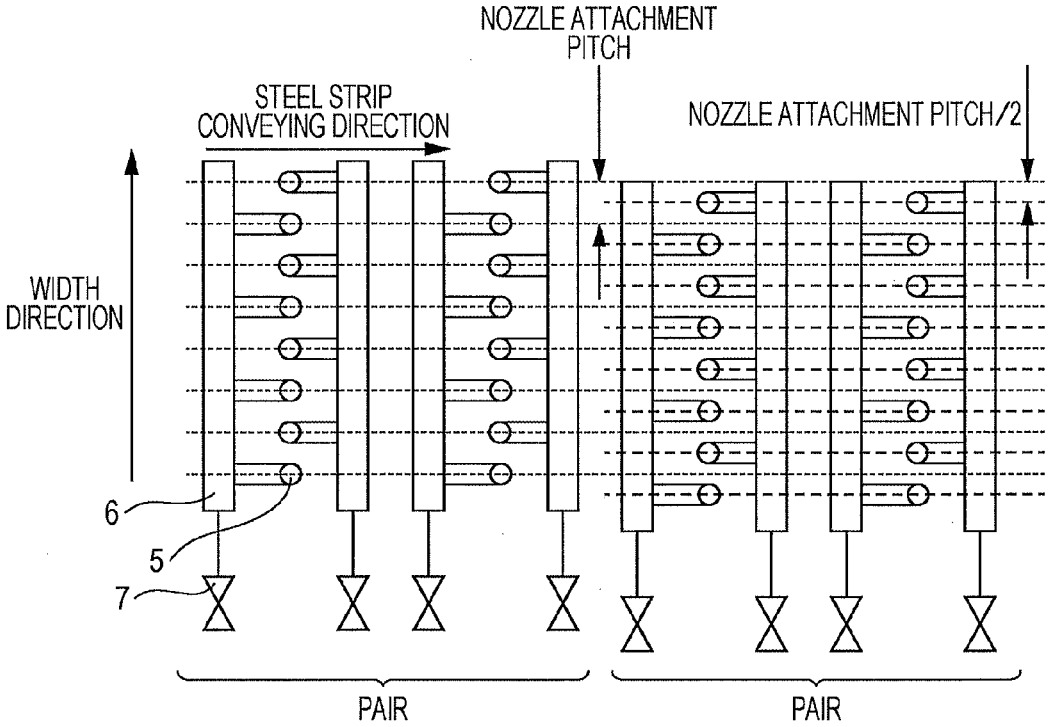
FIG. 11 shows a state where two cooling apparatuses are referred to as a pair, and the nozzle placement positions in the width direction are displaced by ½ of the nozzle attachment pitch in adjacent pairs.
Figure 12:
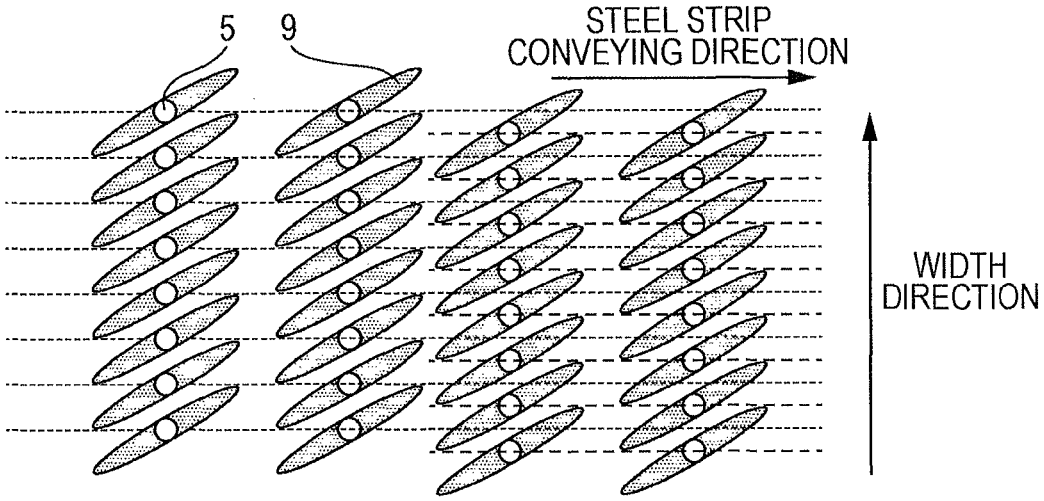
FIG. 12 shows a spray pattern in FIG. 11 (two system spray).

In addition, it is more preferable that two sets of lower surface cooling apparatuses placed between table rollers in the conveying direction be referred to as a pair, and the nozzle placement positions in the width direction be displaced by ½ of the nozzle attachment pitch in adjacent pairs as shown in FIG. 11. Spray patterns in the case of such arrangement are shown in FIG. 12 (two-system spray) and FIG. 13 (one-system spray). The positions of the ends of sprays in the width direction of the steel strip can differ among the four inter-table-roller spaces. A schematic diagram of the flow rate distribution in the case where one-system spray is performed in such arrangement is shown in FIG. 14. Compared to the nozzle arrangement illustrated in FIG. 5, the positions of the ends of sprays in the width direction are further dispersed, and the flow rate distribution in the width direction is more uniformized.

Figure 15:
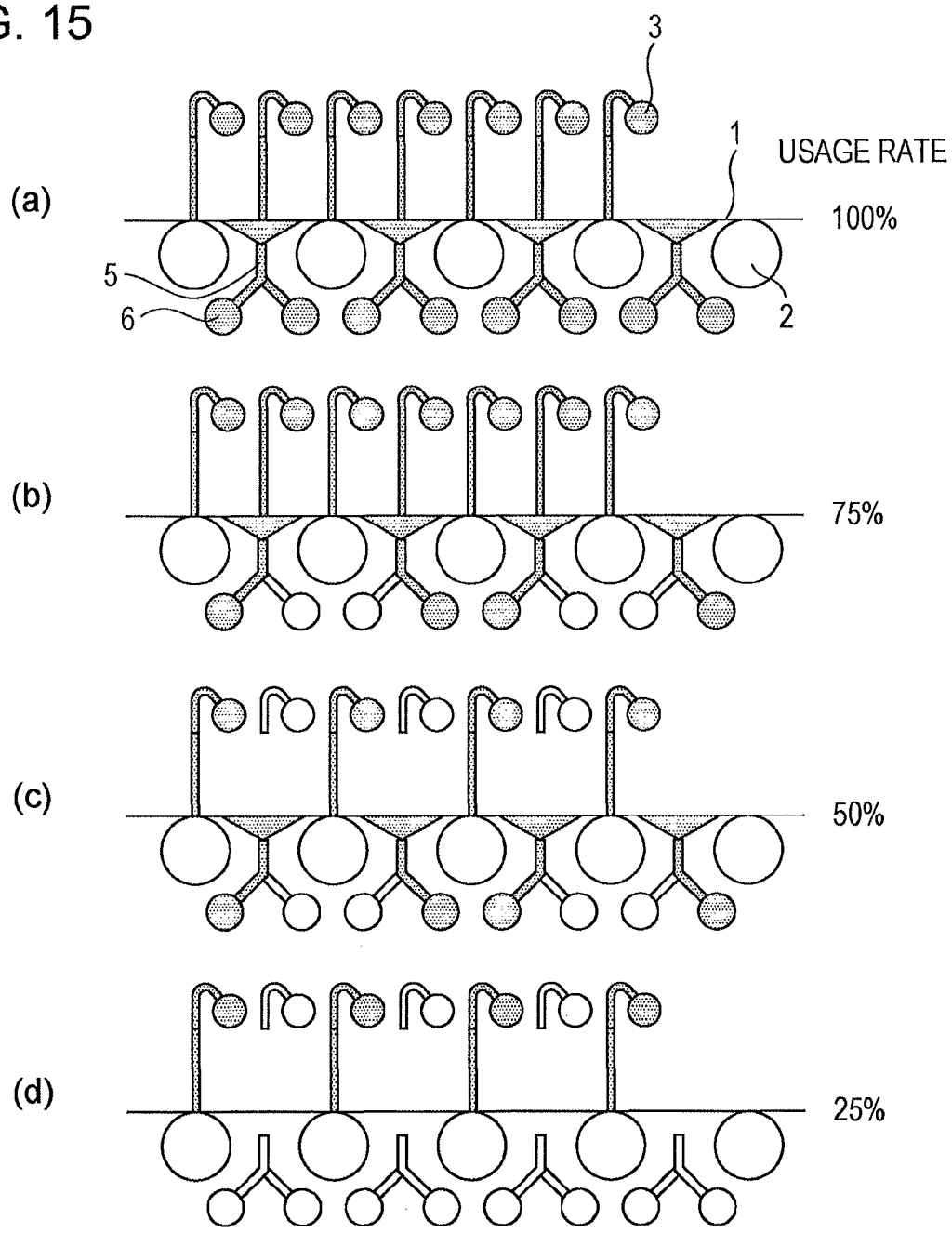
FIG. 15 shows another embodiment of the present invention.

FIG. 15 shows another embodiment of the present invention in which the cooling of the upper surface is combined with the cooling of the lower side.

As shown in the figure, a plurality of pipe laminar nozzles 3 are arranged such that cooling water falls onto the upper surfaces of table rollers and into inter-table-roller spaces, and cooling apparatuses are arranged as spray nozzles 4 for the lower surface. The upper-surface pipe laminar nozzles 3 are each provided with a spray valve 7 (not shown) and are capable of independently performing spraying/stop of spraying of cooling water.

In the case of such arrangement, when the spray rate of cooling water is 100%, the upper surface 50% and the lower surface 50%, and therefore regulation can be performed in a four-stage manner only by spraying/stop of spraying of each header: spray rate 25% [FIG. 15 (*d*)] (upper surface: 25% (only pipe laminar nozzles falling onto table rollers 2 discharge sprays), lower surface: 0% (no spray)); spray rate 50% [FIG. 15 (*c*)] (upper surface: 25% (only pipe laminar nozzles falling onto table rollers 2 discharge sprays), lower surface: 25% (one-system spray)); spray rate 75% [FIG. 15 (*b*)] (upper surface: 50% (pipe laminar nozzles falling onto table rollers 2 and into spaces between table rollers 2 both discharge sprays), lower surface: 25% (one-system spray)); and spray rate 100% [FIG. 15 (*a*)] (upper surface: 50% (pipe laminar nozzles falling onto table rollers 2 and into spaces between table rollers 2 both discharge sprays), lower surface: 50% (two-system spray)).

Although somewhat complicated, if four inter-table-roller spaces are combined doubly, eight-step regulation is possible.

The hatching in the figure shows the supply of cooling water.

An embodiment of the present invention in which the flow rate density balance between the upper and lower surfaces is changed will be described below.

Suppose that, in the cooling apparatus shown in FIG. 15, the cooling water amount density in the case where, for the upper surface, headers whose cooling water falls onto table rollers and into spaces between table rollers both discharge sprays is 1000 L/min·m$^2$, and the cooling water amount density in the case where, for the lower surface, cooling water is supplied from two systems is 700 L/min·m$^2$. In this case, the water amount density per one surface obtained by averaging the upper surface and lower surface obtained by changing the spray rate for the upper surface/lower surface is shown in Table 1. An about five-times change in amount of cooling water from a maximum of 850 L/min·m$^2$ to a minimum of 175 L/min·m$^2$ can be regulated only by eight-stage spray patterns.

TABLE 1

| | No. | | | | | | | |
|---|---|---|---|---|---|---|---|---|
| | 1 | 2 | 3 | 4 | 5 | 6 | 7 | 8 |
| Upper spray rate (%) (Amount of water: L/min · $m^2$) | 50 (1000) | 25 (500) | 0 (0) | 50 (1000) | 25 (500) | 0 (0) | 50 (1000) | 25 (500) |
| Lower spray rate (%) (Amount of water: L/min · $m^2$) | 50 (700) | 50 (700) | 50 (700) | 25 (350) | 25 (350) | 25 (350) | 0 (0) | 0 (0) |
| Upper/lower average water amount per one surface (L/min · $m^2$) | 850 | 600 | 350 | 675 | 425 | 175 | 500 | 250 |

A case where upper surface: 1000 L/min · $m^2$ (full spray), lower surface: 700 L/min · $m^2$ (full spray).

The spray rate in the case of full spray (total of both surfaces 1700 L/min · $m^2$, average water amount of one surface 850 L/min · $m^2$) is 100%, the upper spray rate is 50% at the time of 1000 L/min · $m^2$ (full spray), and the lower spray rate is 50% at the time of 700 L/min · $m^2$ (full spray).

A case of application to cooling of the lower surface of a hot-rolled steel strip has been described. However, from the principle thereof, application to cooling of the upper surface of a hot-rolled steel strip is also possible. Of course, the cooling method of the present invention can also be applied to both the upper surface and lower surface.

Although flat spray nozzles have been described as the spray nozzles 5, elliptic or rectangular sprays may be used. On the other hand, considering overlapping of spray patterns in the case of one-system spray, the ratio of thickness to spread width of sprayed water (FIG. 7) is preferably as small as possible. It is preferable that at least the thickness is smaller than the nozzle pitch in the width direction and the ratio of thickness to spread width is 0.4 or less.

Figure 16:
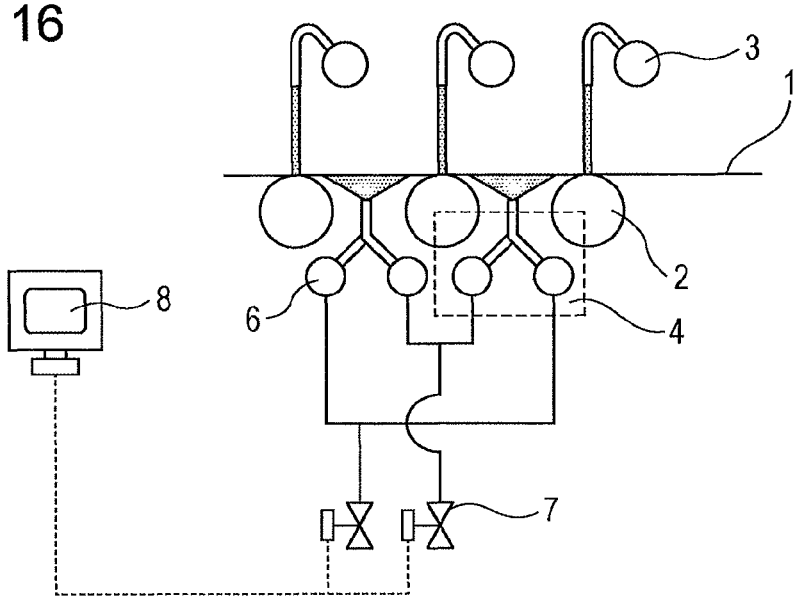
FIG. 16 shows another embodiment of the present invention.

FIG. 16 shows another embodiment concerning pipe system and control mechanism 8. Here, a plurality of pipes of headers 6 used when only one system sprays for each lower surface cooling apparatus 4 are collected into one spray valve 7, and injection/stop of cooling water is controlled with a control mechanism 8. Thus, the number of spray valves 7 can be reduced, and the number of control points in the control mechanism 8 and the number of cables are reduced, and therefore the facility cost can be reduced.

EXAMPLES

Examples of the present invention will be described.

In the examples, in the hot-rolled steel strip manufacturing line of FIG. 1, a slab having a thickness of 250 mm was heated up to 1200° C. in the heating furnace 30 and was subsequently rolled by the rough rolling mill group 31 and the finish rolling mill group 32 so as to be 3.2 mm thick and 1200 mm wide, and was then cooled by the cooling apparatus 33, and was coiled by the coiler 34. The temperature after the completion of rolling and after the completion of cooling was measured by the radiation thermometer 35. The temperature after the completion of rolling was 850° C., and the temperature after the completion of cooling was 550° C. The steel strip passing speed during cooling was 550 mpm.

As shown in FIG. 2, the cooling apparatus 33 included pipe laminar nozzles 3 for the upper surface, and spray cooling apparatuses 4 for the lower surface. The flow rate density of spray per unit area was 1000 L/min·$m^2$ in the cooling of the upper surface, and 1000 L/min·$m^2$ in the cooling of the lower surface when two systems sprayed for one place between table rollers.

Figure 17:
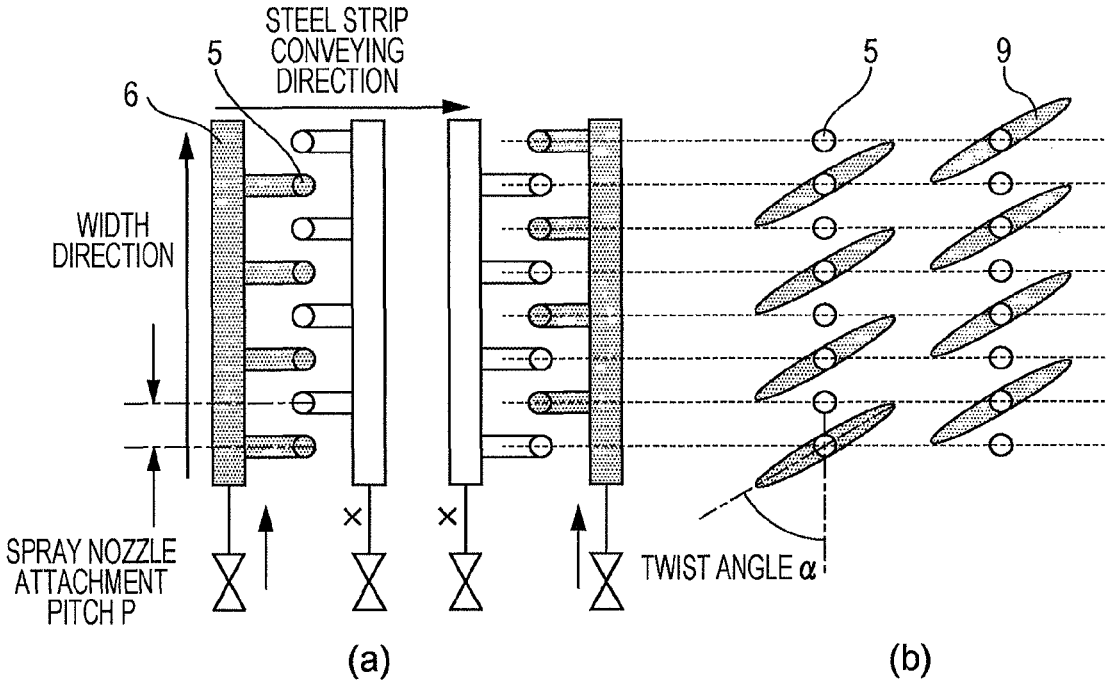
FIG. 17 shows the detailed arrangement of lower surface nozzles in an example of the present invention.
Figure 18:
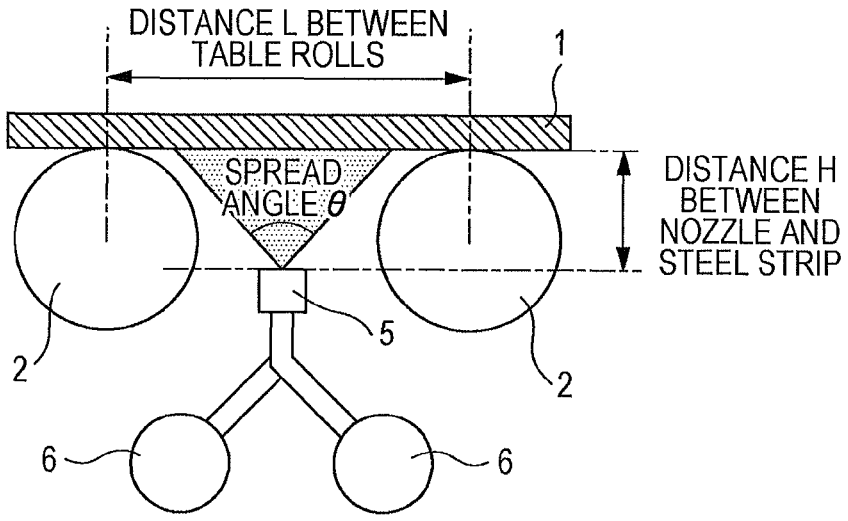
FIG. 18 shows the detailed arrangement of lower surface nozzles in the example of the present invention.

The detailed arrangement of lower surface nozzles will be described with reference to FIG. 17 and FIG. 18. The spray nozzle pitch P was 80 mm, the distance between table rollers was 420 mm, and the twist angle $\alpha$ of spray was 42°, and such spray nozzles were selected that, at a position where cooling water sprayed from a spray nozzle collided with the steel strip, as shown in FIG. 17, the central axis of the adjacent nozzle in the width direction coincides with the position of the end part of the sprayed water in the width direction.

The distance between the nozzles and the steel strip was 140 mm, the diameter of table rollers was 350 mm, and the spread angle of spray was 90°.

Table 2 shows the results of cooling in examples of the present invention and a comparative example.

One system of the upper surface pipe laminar 3 (one group in the width direction) and one system of the lower surface spray nozzles 5 (one group in the width direction) in FIG. 2 will be collectively referred to as one cooling header.

TABLE 2

Figure 13:
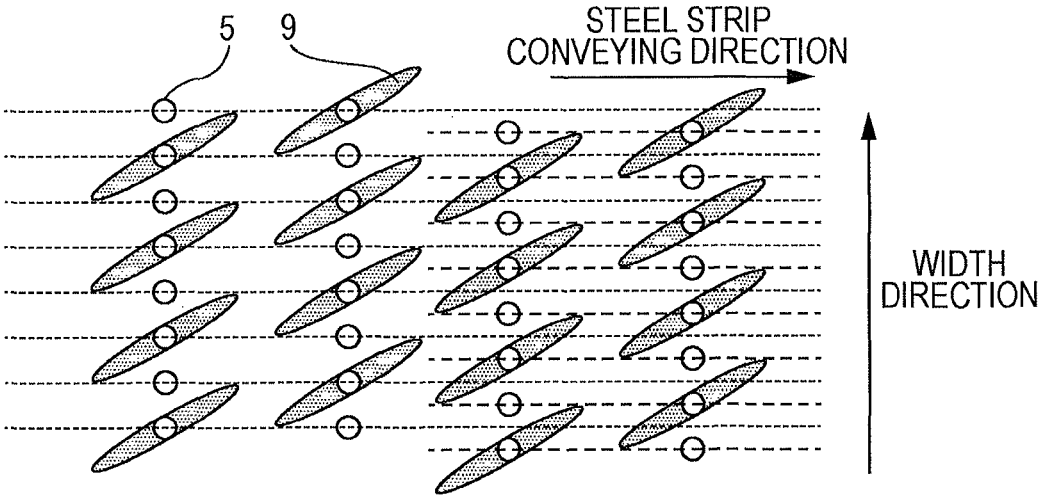
FIG. 13 shows a spray pattern in FIG. 11 (one system spray).
Figure 14:
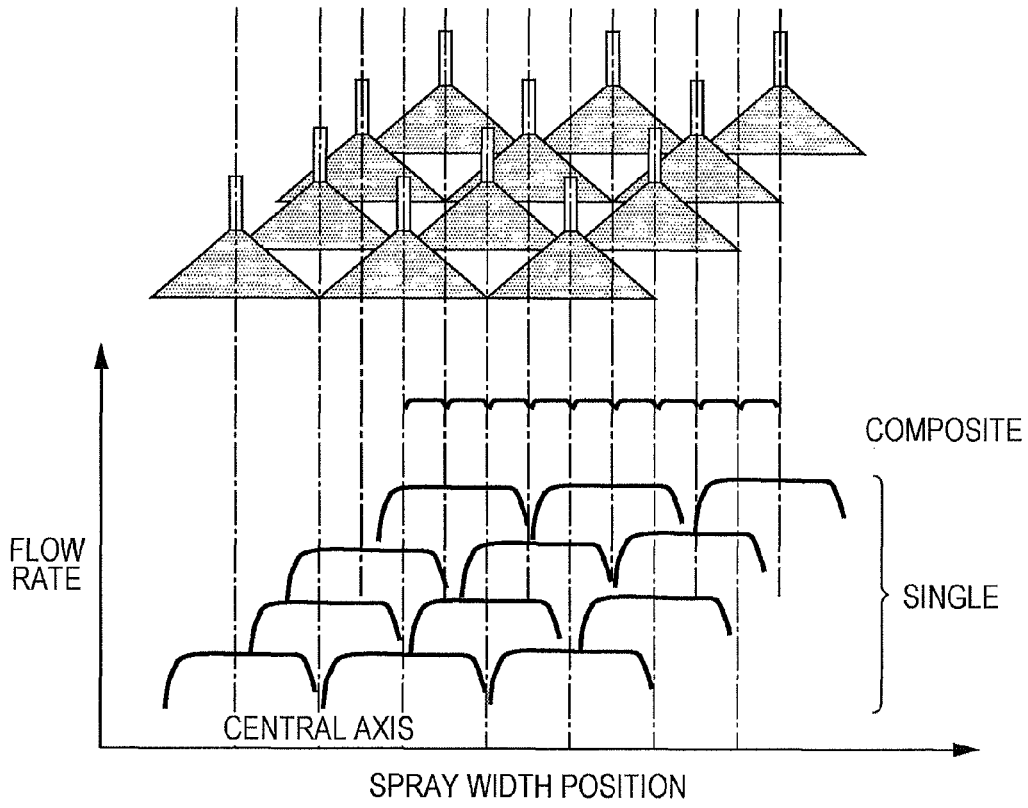
FIG. 14 is a schematic diagram of the flow rate distribution in FIG. 13 (one system spray).

| | Upper surface Pipe laminar cooling | Lower surface Spray cooling (Spray system) | Spray state of lower surface | Number of headers Upper surface/ lower surface | Cooling rate (° C./s) | Temperature deviation in width direction (° C.) |
|---|---|---|---|---|---|---|
| Example 1 of present invention | Spray | 2 system | FIG. 4(b) | 92/92 | 70 | 28 |
| Example 2 of present invention | Spray | 1 system | FIG. 5(b) | 120/120 | 54 | 31 |
| Example 3 of present invention | Spray | 0 system | | 164/0 | 40 | 30 |
| Example 4 of present invention | Spray | 2 system | FIG. 12 | 92/92 | 71 | 26 |
| Example 5 of present invention | Spray | 1 system | FIG. 13 | 120/120 | 55 | 29 |

TABLE 2-continued

| | Upper surface Pipe laminar cooling | Lower surface Spray cooling (Spray system) | Spray state of lower surface | Number of headers Upper surface/ lower surface | Cooling rate (° C./s) | Temperature deviation in width direction (° C.) |
|---|---|---|---|---|---|---|
| Comparative example | Spray | 1 system | FIG. 8(b) | 120/120 | 53 | 68 |

In examples 1 to 3 of the present invention, the spray system of cooling water for the upper surface was changed, and the change in cooling rate was examined.

First, in example 1 of the present invention, as shown in FIG. 4, two systems sprayed for the lower surface, and 92 cooling headers sprayed to each of the upper surface/lower surface. The cooling rate at this time was 70° C./s.

Next, in example 2 of the present invention, as shown in FIG. 5, one system sprayed in the cooling of the lower surface, and 120 cooling headers sprayed to each of the upper surface/lower surface. The cooling rate at this time was 54° C./s.

In example 3 of the present invention, spray for cooling the lower surface was not performed, and 164 cooling headers sprayed only to the upper surface. The cooling rate at this time was 40° C./s.

Thus, in examples 1 to 3 of the present invention, the cooling rate was able to be regulated from 40° C./s to 70° C./s. The temperature deviation in the width direction after cooling was good, about 30° C.

This confirms that, in the present invention, in the cooling after finish rolling in the hot-rolled steel strip manufacturing line, the cooling rate can be easily regulated. As a result, by using the present invention, various hot-rolled steel strips can be made. In addition, it is made possible to manufacture hot-rolled steel strips having the same strength, toughness, and the like as those of conventional ones without adding a special element.

Examples 4 and 5 of the present invention are the results of the pipe configuration of FIG. 11. Nozzles of adjacent pairs were displaced by ½ of nozzle attachment pitch in the width direction.

In example 4 of the present invention, as shown in FIG. 12, two systems sprayed to the lower surface, and 92 cooling headers sprayed to each of the upper surface/lower surface. The cooling rate at this time was 71° C./s, and was about the same as that in example 1 of the present invention. The temperature deviation in the width direction after cooling was 26° C., and the temperature deviation was slightly smaller than in example 1 of the present invention, in which the cooling rate was almost the same. This is the result of further dispersing the water amount distribution after spraying by displacing some of spray nozzles by ½ of attachment pitch in the width direction.

In example 5 of the present invention, as shown in FIG. 13, two systems sprayed to the lower surface, and 120 cooling headers sprayed to each of the upper surface/lower surface. The cooling rate at this time was 55° C./s, and was the same as that in example 2 of the present invention. The temperature deviation in the width direction after cooling was 29° C., and the temperature deviation was slightly smaller than in example 2 of the present invention, in which the cooling rate was almost the same. This is the result of further dispersing the water amount distribution after spraying by displacing some of spray nozzles by ½ of attachment pitch in the width direction.

In contrast, in the comparative example, although one system sprayed in the cooling of the lower surface as shown in FIG. 8, adjacent inter-table-roller spaces are the same in nozzle arrangement in the steel strip conveying direction, and 120 cooling headers sprayed to each of the upper surface/lower surface. The cooling rate at this time was 53° C./s, which was about the same as that in example 2 of the present invention, whereas the temperature deviation in the width direction was 68° C., which was larger than that in example 2 of the present invention.

Figure 19:
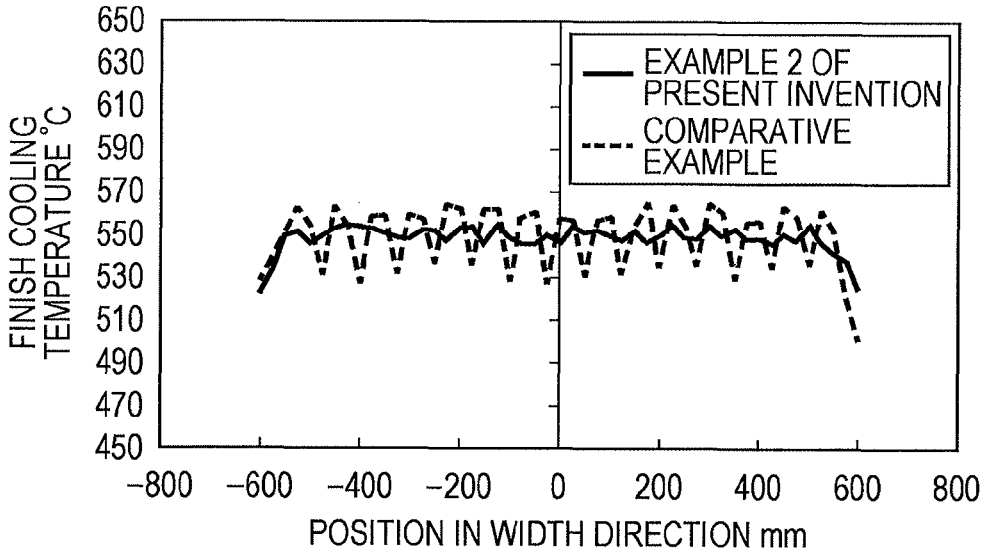
FIG. 19 shows the temperature distribution of example 2 of the present invention and comparative example.

FIG. 19 shows the temperature distribution of example 2 of the present invention and comparative example, which are about the same in cooling rate. In example 2 of the present invention, there is a slight decrease in temperature at the plate ends, but the temperature is almost uniform in the middle of the plate width. In contrast, in the comparative example, high-temperature regions and low-temperature regions are generated at a pitch of about 80 mm. It is thought that this is caused by failing to disperse the flow rate distribution after spraying in the width direction.

REFERENCE SIGNS LIST

1 steel strip
2 table roller
3 pipe laminar nozzle
4 spray cooling apparatus
5 spray nozzle
6 cooling header
7 spray valve
8 spray valve control mechanism
9 sprayed water
30 heating furnace
31 rough rolling mill group
32 finish rolling mill group
33 run out table cooling apparatus
34 coiler
35 radiation thermometer

The invention claimed is:

1. A method for cooling a hot-rolled steel strip, the method comprising:

preparing a cooling apparatus including at least a couple of cooling headers having a plurality of spray nozzles arranged in a width direction, the cooling headers being arranged in a steel strip conveying direction, spray nozzles of one of the couple of cooling headers are arranged on a straight line extending in the width direction, and spray nozzles of another of the couple of cooling headers are arranged on the straight line between respective spray nozzles of the one of the couple of cooling headers, supply of cooling water for the one of the couple of cooling headers and for the other of the couple of cooling headers being performed using two systems of supply pipes, respectively, a valve being attached to each of the two systems of supply pipes of cooling water so that spraying or stop of spraying of cooling water from the spray nozzles of the one of the couple of cooling heads and spraying or stop of spraying of cooling water from the spray nozzles of the other of the couple of cooling headers can be independently performed, wherein when increasing cooling rate, supplying cooling water to both of the one and the other of the couple of cooling headers from both of the two systems of supply pipes and spraying cooling water from all of the spray nozzles of the couple of cooling headers, and wherein when decreasing cooling rate, supplying cooling water to any one of the one and the other of the couple of cooling headers from a corresponding one of the two systems of supply pipes and spraying cooling water from every other spray nozzle of the couple of cooling headers in the width direction.

2. The method for cooling a hot-rolled steel strip according to claim 1, wherein two couples of the cooling headers in the steel strip conveying direction are referred to as a pair, in each pair, the spray nozzles of one of the couple of the cooling headers are placed at the same position in the width direction as the spray nozzles of the other couple of cooling headers, and when spraying cooling water from any one of the two systems of supply pipes in each pair, the spray nozzles of the one of the couple of cooling headers and the spray nozzles of the other of the couple of cooling headers spray cooling water from alternate positions in the width direction.

3. The method for cooling a hot-rolled steel strip according to claim 1, wherein the spray nozzles have a rectangular or elliptic spray pattern, and are arranged in such a manner that, when performing supply of cooling water from two systems and when cooling water collides with the steel strip, the position of the end of the spray colliding part collides with a position located on the opposite side of the central axis of the adjacent nozzle from the nozzle spraying cooling water and located 0 to 30 mm from the central axis of the adjacent nozzle.

4. The method for cooling a hot-rolled steel strip according to claim 1, wherein two couples of the cooling headers in the steel strip conveying direction are referred to as a pair, and in each pair, the spray nozzles of one of the couple of the cooling headers are placed at the same position in the width direction as the spray nozzles of the other of the couple of cooling headers, and the spray nozzles in a pair are displaced in the width direction by ½ of nozzle pitch from the spray nozzles in another adjacent pair.

5. The method for cooling a hot-rolled steel strip according to claim 1, wherein the upper surface and lower surface of the steel strip differ in cooling water amount density, and, in each cooling headers for the upper surface and lower surface of the steel strip, the number of supply pipes for cooling water is changed individually.

6. The method for cooling a hot-rolled steel strip according to claim 1, wherein the method is applied to cooling of the lower surface of the steel strip.

7. A cooling apparatus for cooling a hot-rolled steel strip, comprising:

at least a couple of cooling headers having a plurality of spray nozzles arranged in a width direction, the cooling headers being arranged in a steel strip conveying direction, spray nozzles of one of the couple of cooling headers are arranged on a straight line extending in the width direction, and spray nozzles of another of the couple of cooling headers are arranged on the straight line between respective spray nozzles of the one of the couple of cooling headers, wherein supply of cooling water for the one of the couple of cooling headers and for the other of the couple of cooling headers is performed using two systems of supply pipes, respectively, a spray valve is attached to each of the two systems of supply pipes of cooling water so that spraying or stop of spraying of cooling water from the spray nozzles of the one of the couple of cooling headers and spraying or stop of spraying of cooling water from the spray nozzles of the other of the couple of cooling headers can be independently performed, and wherein the apparatus includes a control mechanism that makes it possible to, when increasing cooling rate, supply cooling water to both of the one and the other of the couple of cooling headers from both of the two systems of supply pipes and spray cooling water from all of the spray nozzles of the couple of cooling headers, and to, when decreasing cooling rate, supply cooling water to any one of the one and the other of the couple of cooling headers from corresponding one of the two systems of supply pipes and spray cooling water from every other spray nozzle of the couple of cooling headers in the width direction.

8. The apparatus for cooling a hot-rolled steel strip according to claim 7, wherein two couples of the cooling headers in the steel strip conveying direction are referred to as a pair, and in each pair, the spray nozzles of one of the couple of the cooling headers are placed at the same position in the width direction as the spray nozzles of the other couple of cooling headers, and wherein the apparatus has a control function capable of opening and closing the spray valves in such a manner that, when spraying cooling water from any one of the two systems of supply pipes in each pair, the spray nozzles of the one of the couple of cooling headers and the spray nozzles of the other of the couple of cooling headers spray cooling water from alternate positions in the width direction.

9. The apparatus for cooling a hot-rolled steel strip according to claim 7, wherein the spray nozzles have a rectangular or elliptic spray pattern, and are arranged in such a manner that, when cooling water collides with the steel strip, the position of the end of the spray colliding part is located on the opposite side of the central axis of the adjacent nozzle from the nozzle spraying cooling water and is located 0 to 30 mm from the central axis of the adjacent nozzle.

10. The apparatus for cooling a hot-rolled steel strip according to claim 7, wherein two couples of the cooling headers in the steel strip conveying direction are referred to as a pair, and in each pair, the spray nozzles of one of the two couples of the cooling headers are placed at the same position in the width direction as the spray nozzles of the other of the two couples of cooling headers, and the spray nozzles in a pair are displaced in the width direction by ½ of nozzle pitch from the spray nozzles in another adjacent pair.

11. The apparatus for cooling a hot-rolled steel strip according to claim 7, wherein the apparatus has a control function that, when two-system cooling water is supplied, is capable of spraying in such a manner that the upper surface and lower surface of the steel strip differ in cooling water amount density, and is capable of opening and closing the spray valves in order to change the number of supply systems for cooling water individually, in each cooling headers for the upper surface and lower surface of the steel strip.

12. The apparatus for cooling a hot-rolled steel strip according to claim 7, wherein the apparatus is applied to cooling of the lower surface of the steel strip.

* * * * *